US011613972B2

(12) United States Patent
Whiteman et al.

(10) Patent No.: US 11,613,972 B2
(45) Date of Patent: Mar. 28, 2023

(54) SYSTEM AND METHOD FOR LOW PRESSURE GAS LIFT ARTIFICIAL LIFT

(71) Applicant: INTELLIGAS CSM SERVICES LIMITED, Crestmead (AU)

(72) Inventors: Paul Anthony Whiteman, Crestmead (AU); Derek Shane Fekete, Crestmead (AU)

(73) Assignee: IntelliGas CSM Services Limited, Crestmead (AU)

( * ) Notice: Subject to any disclaimer, the term of this patent is extended or adjusted under 35 U.S.C. 154(b) by 0 days.

(21) Appl. No.: 16/646,831

(22) PCT Filed: Sep. 17, 2018

(86) PCT No.: PCT/AU2018/051012
§ 371 (c)(1),
(2) Date: Mar. 12, 2020

(87) PCT Pub. No.: WO2019/051561
PCT Pub. Date: Mar. 21, 2019

(65) Prior Publication Data

US 2020/0270975 A1 Aug. 27, 2020

(30) Foreign Application Priority Data

Sep. 15, 2017 (AU) ..... 2017903748
Oct. 6, 2017 (AU) ..... 2017904037

(51) Int. Cl.
*E21B 43/12* (2006.01)
*E21B 43/38* (2006.01)
*E21B 43/34* (2006.01)

(52) U.S. Cl.
CPC ..... *E21B 43/122* (2013.01); *E21B 43/12* (2013.01); *E21B 43/13* (2020.05); *E21B 43/34* (2013.01);

(Continued)

(58) Field of Classification Search
CPC ..... E21B 43/122; E21B 43/13; E21B 43/385; E21B 43/123; E21B 43/38
See application file for complete search history.

(56) References Cited

U.S. PATENT DOCUMENTS 5,172,717 A 12/1992 Boyle et al.
5,501,279 A * 3/1996 Garg ..... E21B 43/006 166/168

(Continued)

FOREIGN PATENT DOCUMENTS

EP 0756065 A1 1/1997
WO 95226682 8/1995
WO 2015070913 A1 5/2015

OTHER PUBLICATIONS

International Search Report and Written Opinion for PCT/AU2018/051012 dated Dec. 3, 2018.

(Continued)

*Primary Examiner* — Nicole Coy
(74) *Attorney, Agent, or Firm* — IntelliGas CSM Services Limited

(57) ABSTRACT

A system for applying low pressure gas lift artificial lift enables improved efficiency in gas and oil well production. The system comprises: a central tubing in a well hole of the well, the tubing having a well head end and a well sump end; an annulus that extends around the central tubing between from the well head end to the sump end; a compressed gas source; a gas lift gas line connecting the compressed gas source to the well hole; a gas compressor having an input and an output, wherein the output is connected to the annulus; a flowline connected to the well head end of the central tubing; and an automatically controlled flowline choke in the flowline.

20 Claims, 13 Drawing Sheets

(52) U.S. Cl.
CPC ..... *E21B 43/35* (2020.05); *E21B 43/38* (2013.01); *E21B 43/385* (2013.01); *E21B 43/123* (2013.01)

(56) References Cited

U.S. PATENT DOCUMENTS

| | | | | |
|---|---|---|---|---|
| 5,904,209 | A * | 5/1999 | Kenworthy | E21B 43/38 166/372 |
| 6,595,294 | B1 | 7/2003 | Dalsmo et al. | |
| 6,991,034 | B2 * | 1/2006 | Wilde | E21B 43/12 166/250.15 |
| 7,275,599 | B2 * | 10/2007 | Wilde | E21B 43/12 166/372 |
| 10,077,642 | B2 * | 9/2018 | Elmer | E21B 43/122 |
| 10,119,384 | B2 * | 11/2018 | Gettis | E21B 43/38 |
| 10,697,278 | B2 * | 6/2020 | Elmer | E21B 43/34 |
| 10,746,007 | B2 * | 8/2020 | Gettis | E21B 43/38 |
| 2006/0000357 | A1 * | 1/2006 | Michael | C01B 21/0422 95/273 |
| 2008/0271893 | A1 | 11/2008 | Hill et al. | |
| 2012/0318523 | A1 | 12/2012 | Wilde et al. | |

OTHER PUBLICATIONS

International Preliminary Report on Patentability for PCT/AU2018/051012 dated Jan. 15, 2020.

* cited by examiner

SYSTEM AND METHOD FOR LOW PRESSURE GAS LIFT ARTIFICIAL LIFT

CROSS-REFERENCE TO RELATED APPLICATIONS

This application is a national stage of, and claims priority to, Patent Cooperation Treaty Application No. PCT/AU2018/051012 filed on Sep. 17, 2018, which application claims priority to Australian Provisional Application No. 2017903748 filed on Sep. 15, 2017 and Australian Provisional Application No. 2017904037 filed on Oct. 6, 2017, which applications are hereby incorporated herein by reference in their entireties.

FIELD

The present disclosure relates generally to systems and methods for extracting coal seam methane or oil from underground wells.

BACKGROUND

Coal seam methane (CSM), also known as coal bed methane (CBM) or coal seam gas (CSG), is a form of natural gas that is found in coal beds, and has become a popular fuel in Australia, the United States, Canada and other countries. CSM is generally extracted through wellbores that extend into the coal seam typically found 100 to 1500 metres below ground.

The gas is adsorbed in the coal and is released by lowering the pressure in the coal, initially by removal of ground water that maintains hydrostatic pressure on the coal bed. Lowering the pressure moves the coal below the saturation point on the adsorption isotherm and gas is produced. If water is removed too quickly and pressure is not otherwise maintained reasonably near to the natural formulation pressure, and subsequently within a limited range of the desorption isotherm saturation pressure during production, then damage can occur to the coal formation, most notably in low permeability coals. This damage can limit producibility and ultimate recoverability of gas from the gas reserve.

Conventional CSM wells typically use down bore pumps for de-watering. These pumps are commonly progressive cavity pumps (PCP) positioned at the bottom of a well and are used to pump water to the well head at the surface. However, the use of such cavity pumps is often problematic, as a power failure or failure of a cavity pump can result in a well logging up with water and thus ceasing gas production from the well. Additionally, down hole pumps create a standing column of water on a pump discharge, which column of water is often laden with particulates and sand, and which on loss of power to the cavity pump can settle in minutes or hours, forming a cement like plugging of the well tubing after which the remedy is often an expensive workover requiring full extraction of the pump and drive stem. Such a workover cost is sometimes so cost prohibitive that wells are abandoned. Additionally, with a PCP, the flow paths separate the water and gas streams with the gas stream flowing up the annulus, often carrying erosive particles from the formation at high velocity causing erosion of wellhead components which may then require a full workover including a wellhead repair/replacement to rectify.

More broadly the majority of oil, natural gas and CSM wells will at some point either, a) lack the required reservoir pressure to naturally produce reservoir fluids to the surface or, b) only naturally produce these fluids at rates which are considered to be sub-economic. To overcome this problem, wells can be equipped with Artificial Lift (AL) systems. AL systems enhance the production of reservoir fluids (gas, oil, water, condensate) to surface.

There are two basic types of AL. The first is pumping AL, as described above concerning CSM wells, and which can include beam pumps, electric submersible pumps, hydraulic pumps, jet pumps, plunger lift and progressive cavity pumps. The other type is gas lift AL.

Gas lift AL, is a technique that is commonly used to assist production in oil wells and to remove condensate in natural gas wells. In its simplest form it involves injecting gas at the surface into the oil wellbore annulus, and the gas then travels to the bottom of the oil well where it flows into the production tubing. The gas then mixes with the oil in the tubing and lowers the overall density of the gas-liquid mixture, which assists the mixture to flow upward through the tubing to the well head. In typical deep wells multiple gas valves may be installed at various depths to introduce gas into the production tubing to unload the well.

Gas lift AL can assist oil wells to achieve more predictable production in the face of varying oil well conditions, such as reduced reservoir pressure, increased water cuts and decreased gas-liquid ratios.

However, there are many disadvantages associated with traditional gas lift AL. For example, traditional gas lift AL systems require a high pressure natural gas source to be available at the wellhead location which can be achieved by a high pressure gas compressor or some other high pressure gas source such as a pipeline from a central location. Thus, for widely spaced wells, provision of high-pressure gas sources can be impractical and/or uneconomical, due to the high cost of running a distributed injection gas network or the number of expensive high pressure gas compressors required.

Further, due to added complexity, the project planning and installation of a traditional gas lift AL system typically requires a longer lead time compared to a single pumping well system.

Also, corrosive gasses such as carbon dioxide and hydrogen sulfide can severely increase the cost of gas lift operations because the gas may need to be treated at central processing facilities before use.

Further, converting older wells to a traditional gas lift AL system typically requires high levels of well casing integrity protection. Where casing integrity is a significant concern, coiled tubing gas-lift (where high-pressure gas is injected down a coiled tubing capillary located inside the production tubing string) can be employed. However, the nature of injecting gas down a small capillary requires an expensive continuous high pressure gas source for operation due to the increased surface gas pressure required to overcome the internal flowing losses within the capillary.

Further, considering an example in CSM production, the flowing losses in a tubing string using gas lift AL significantly increase with water production rates, requiring higher bottom hole pressures to lift the mixed fluid column into the surface facilities. This results in higher bottom hole pressures and less production than would be the case with pump AL.

Further when designing a local well head compressor for gas lift AL, the pressure ratios required to minimize bottom hole pressure and optimize production will not be capable of unloading a liquid logged up well. Providing a second continuous high pressure source, that would otherwise be required, is expensive and often impractical for industry.

Most modern gas lift systems utilize a form of wellhead controller to optimize the injection gas rate. The Article "Wellhead monitors automate Lake Maracaibo gas-lift" published by J C Adjunta and A Majek on pages 64-67 of the Oil and Gas Journal of 28 Nov. 1994 provides an example of a wellhead controller whereby an automatic choke may be used to vary the flow of lift-gas such that it stays close to a calculated optimum.

International patent application no. PCT/EP1995/00623 also reveals that downhole adjustable chokes to control the injection gas entering the production tubing have limitations in terms of installation difficulty, operation and maintenance as well as being cost prohibitive in many applications.

European patent application publication no. EP 0 756 065 A1 also reveals a system comprising a variable surface flowline choke for adjusting flow of crude oil through the production tubing and a surface control module for dynamically controlling the opening of the choke, preferably the control module is set to dynamically control the opening of the choke in response to variation in the fluid pressure within the lift-gas conduit.

Further, the system of EP 0 756 065 A1 claims to utilize a surface gas injection choke which acts together with the flowline choke and a control module. The principle operation of the control module is that it adjusts the opening of the flowline choke such that flow of lift-gas through the downhole valve remains approximately constant. That is achieved by maintaining constant differential pressure across the downhole valve/orifice. The pressure downstream of the orifice can be influenced by varying the backpressure at the wellhead, i.e., the tubing head pressure. In this way the backpressure exerted by the tubing head pressure on the produced fluid mixture is varied such that the backpressure increases in response to a decrease in the measured casing head pressure and vice versa. This variation of the tubing head pressure, HP, is an adequate measure to accomplish a substantially constant rate of injection of lift gas at the downhole orifice.

Further, the system described in EP 0 756 065 A1 aims to minimize casing head pressure (CHP) by varying the opening of the flowline choke.

There are disadvantages to the system described in EP 0 756 065 A1 in that it relies on accurate measurement of casing head pressure but also requires the control module to calculate expected downhole pressure and flow at the orifice or valve. Calculating the downhole pressure requires an accurate calculation of the pressure drop across the entire annulus space. Particularly where the annulus can be thousands of meters long and where there can be irregular sizes of tubing in the well, an accurate downhole pressure determination at the valve/orifice can be difficult to determine.

Additionally, the nature of gas lift in an oil well causes two phase flow in the tubing string that comprises discrete bubbles expanding between the bottom and top of the tubing. That makes the ability to calculate the head of the fluid at any given time extremely problematic due to irregular and unpredictable phase behaviour.

There is therefore a need for an improved system and method of gas lift AL.

SUMMARY

In a first aspect, although it need not be the only or the broadest aspect, the disclosure resides in a system for applying gas lift artificial lift, the system comprising:

a central tubing in a well hole of the well, the tubing having a well head end and a well sump end;

an annulus that extends around the central tubing between from the well head end to the sump end;

a compressed gas source;

a gas lift gas line connecting the compressed gas source to the well hole;

a gas compressor having an input and an output, wherein the output is connected to the annulus;

a flowline connected to the well head end of the central tubing; and an automatically controlled flowline choke in the flowline.

Preferably, the compressed gas source is a storage vessel.

Preferably, the storage vessel is packaged in a storage crate.

Preferably, the flowline choke and the casing head valve are automatically modulated in tandem by a controller, whereby the controller adjusts the flow in the tubing to maintain a critical velocity of gas through the tubing and a desired production pressure.

Preferably, the system further comprises a packer positioned adjacent the central tubing in the wellbore.

Preferably, the system further comprises a packer positioned adjacent the central tubing in the wellbore and wherein select sized gas passages extend through the packer.

Preferably, the compressed gas storage vessel contains compressed natural gas (CNG).

Preferably, the central tubing includes a foot valve/check valve.

Preferably, the central tubing extends below an intersection of a vertical well and a horizontal well and into a sump.

Preferably, an additional tubing is inserted down the central tubing or annulus and into a sump whereby solids in the sump are elutriated.

Preferably, an additional tubing is inserted down the central tubing to provide gas for initial unloading of the well.

Preferably, the additional tubing for initial unloading and elutriation are the same tube.

Preferably, an additional tubing is installed in the central tubing to provide a separate gas lift tube.

Preferably, the additional tubing is a capillary tubing.

Preferably, flow in the additional tubing is controlled by managing a surface receiver pressure relative to a bottom hole pressure.

Preferably, a gas lift flow rate in the additional tube is metered using a flow meter.

Preferably, a gas lift flow rate in the additional tube is estimated using differential pressure between a surface receiver pressure and a bottom hole pressure.

Preferably, the additional tubing may enter the well via a stuffing box or gland such that it can be moved or height adjusted.

Preferably, the sump is a volume created below an intersection of a vertical well with a horizontal well.

Preferably, the sump comprises an enlarged section of a well and is positioned at a low point in the well.

Preferably, the gas compressor is a reciprocating compressor.

Preferably, the gas compressor is a rotary vane compressor.

Preferably, the gas compressor is a screw compressor.

Preferably, the gas compressor is a piston based gas booster.

Preferably, the well is a coal seam methane well.

Preferably, the well is a natural gas well.

Preferably, the well is shale gas well.

Preferably, the well is an oil well.

Preferably, the automatically controlled flowline choke is a primary flowline choke or a secondary flowline choke.

Preferably, the capillary tubing comprises an unloading port and a pressure-activated elutriation valve at a sump end of the capillary tubing.

In another aspect, although it need not be the only or the broadest aspect, the disclosure resides in a system for applying gas lift artificial lift in a well having a well head end and a well sump end, the system comprising:

a central tubing in a well hole of the well, the tubing extending from the well head end to the well sump end;

an annulus that extends around the central tubing from the well head end to the sump end;

a gas compressor having an input and an output, wherein the output is connected to the annulus;

a flowline connected to the well head end of the central tubing;

an automatically controlled flowline choke in the flowline;

a compressed gas source; and a capillary tubing string in the well hole, connected to the compressed gas source and extending from the well head end to the sump end.

Preferably, the system further comprises a gas flow measurement device located between the compressed gas source and the well head end to measure gas flow into the annulus.

Preferably, the system further comprises an automatically controlled gas lift flow control valve in a gas lift gas line located between the compressor and the well head end.

Preferably, the system further comprises a pressure measurement device located to measure pressure in the connecting pipe.

Preferably, the system further comprises a pressure measurement device located on or adjacent to the well head end to measure pressure in the capillary tubing.

Preferably, the system further comprises a pressure measurement device located on or adjacent to the well head end to measure pressure in the annulus.

Preferably, the system further comprises a gas lift gas flow control valve.

Preferably, the system further comprises a control system that regulates: the automatically controlled flowline choke, the gas lift gas flow control valve and an output of the gas compressor based on inputs from the gas flow measurement device and the pressure measurement device.

BRIEF DESCRIPTION OF THE DRAWINGS

To assist in understanding the disclosure and to enable a person skilled in the art to put the disclosure into practical effect, preferred embodiments of the disclosure are described below by way of example only with reference to the accompanying drawings, in which.

DETAILED DESCRIPTION

Figure 1:
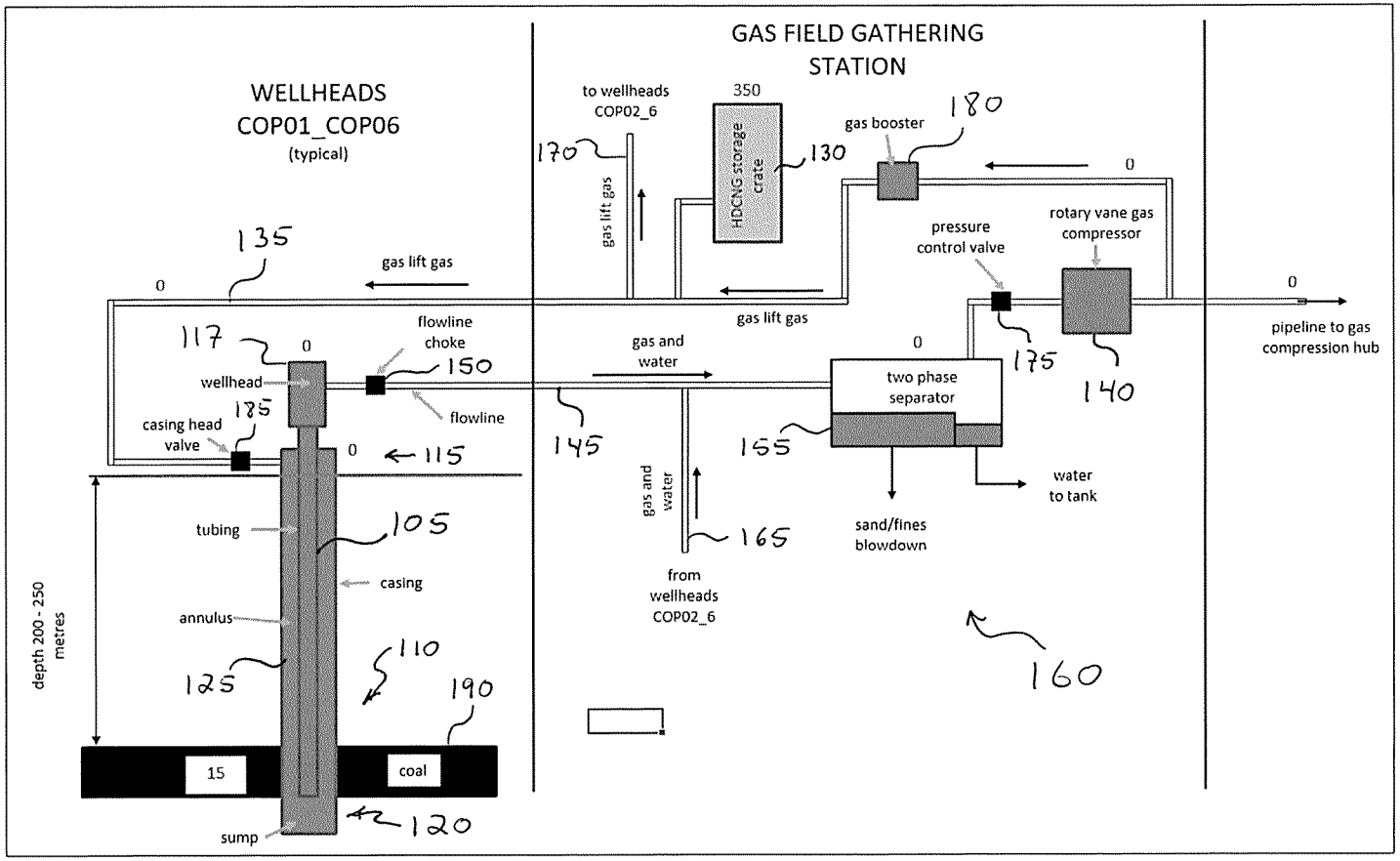
FIG. 1 is a schematic diagram of a gas lift artificial lift system, for applying gas lift artificial lift in a coal seam methane well, where the system is shown in an idle state, according to some embodiments of the present disclosure.

The present disclosure relates to an improved system and method for applying low pressure gas lift artificial lift, and according to some embodiments includes high pressure capillary unloading in production and control of wells, including coal seam methane wells and oil wells. The system and method may be equally applicable to production of natural gas, shale gas or other unconventional gas reserves. Elements of the disclosure are illustrated in concise outline form in the drawings, showing only those specific details that are necessary to understanding the embodiments of the present disclosure, but so as not to clutter the disclosure with excessive detail that will be obvious to those of ordinary skill in the art in light of the present description.

In this patent specification, adjectives such as first and second, left and right, above and below, top and bottom, upper and lower, rear, front and side, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present disclosure.

According to one aspect, the present disclosure is includes a system for applying gas lift artificial lift, the system comprising: a central tubing in a well hole of the well, the tubing having a well head end and a well sump end; an annulus that extends around the central tubing between from the well head end to the sump end; a compressed gas source; a gas lift gas line connecting the compressed gas source to the well hole; a gas compressor having an input and an output, wherein the output is connected to the annulus; a flowline connected to the well head end of the central tubing; and an automatically controlled flowline choke in the flowline.

The present disclosure includes the ability to employ gas lift artificial lift to control well flow from coal seam methane wells and unload liquid loaded wells, and improve gas lift AL effectiveness and economics including in oil wells. Stand-by gas provided by the gas storage vessel provides a backup to produced gas for well unloading operations. Further, the present system enables the substantial elimination of standing columns of water/fluid/suspended solids in the well tube, which can be created when conventional pump AL is used. That means a well can be readily shut down with reduced or minimal risk of the re-start issues that commonly occur with down hole pumps.

Thus, according to some embodiments, gas production flow rates from a CSM well can be matched to gas demand without the risk of production tubing being blocked with solids produced from the well. This in turn can dramatically reduce the total number of wells required to meet demand over a project lifetime.

Further, according to some embodiments, only a small amount of electric power is required for instruments, sensors and controllers at a wellhead location, which power can be provided by solar panels with battery storage.

Further, according to some embodiments, reservoir gas and injection gas may be recycled at the wellhead surface location. Thus instead of requiring diesel-powered electricity generators or cabled electric power the recycled gas can be used as a fuel source for gas fired engines. Furthermore and importantly, the recycled gas can eliminate the requirement for a complex injection gas network, where a high pressure gas line is typically returned from a central compressor station to each well to provide gas lift gas when required. This embodiment effectively creates a "stand alone" gas lift artificial lift system, whereby the only other "stand alone" systems are pumped forms of artificial lift.

Thus the "stand alone" capability of systems of the present disclosure means that well spacing is not limited by proximity to a central gas source.

Further, as water is removed the bottom hole pressure can be controlled by regulating CSM gas production using a flow control valve. This controls gas production by setting the position/pressure on the coal seam adsorption isotherm and also provides a mechanism to eliminate any excessive pressure differential on the coal formation, which may damage the well and reduce the overall recovery of gas over the life of the well. Embodiments of the present disclosure thus produce water and simultaneously control bottom hole pressure to attain a desired gas production rate limited by a set maximum differential pressure on a coal formation.

Further, some embodiments of the present disclosure incorporate an adjustable capillary line that extends down the well. The capillary line is typically inserted through a stuffing box or BOP. The capillary line enables unloading of water in the well, whereby gas is introduced to the well via the capillary line to lighten the standing water column in the tubing. Without the capillary line, introducing gas into the annulus of the present system will increase pressure in the annulus, in order to lift water to surface via the tubing. By introducing gas down the capillary line of a water loaded well, the well can be unloaded with lower pressure exerted on the coal seam or reservoir. Further, the capillary line may be raised and lowered through a well head to aid the elutriation of solids and liquids during maintenance of the well.

Further, systems of the present disclosure require high pressure gas only during well unloading. During steady state operation low pressure gas can be supplied to the casing head annulus, which results in a lower bottom hole pressure and increased well drawdown and production rates compared to coiled tubing gas lift systems.

For example, for a CSM well that is 500 m deep, with a with 2⅞" tubing and a flowing tubing head pressure of 25 psig, the injection gas could lift 85 bbl per day of water injected at 100 psi at a rate of 0.3 mmscf/d.

Those skilled in the art will appreciate that not all embodiments of the present disclosure will necessarily provide all of the above-listed advantages.

In this specification the terms well hole and wellbore are used interchangeably, and define either cased or uncased well holes.

Gas lift essentially maintains a gas flow rate at the sump end of the wellbore above a certain critical rate which prevents a stagnant liquid column forming at the bottom of the wellbore.

There are four processes which work together to enable reservoir fluids to be produced to the surface:

The first process is reduction of the fluid density and the column weight in the production tubing so that the pressure differential between the reservoir and the wellbore is increased.

The second process is expansion of the injection gas so that It pushes liquid ahead of it which further reduces the column weight, while also increasing the pressure differential between the gas or oil reservoir and the well head end of the wellbore.

The third process is the displacement of liquid slugs by large bubbles of gas acting as pistons. The first, second and third process being the method by which a well is unloaded using a capillary line, also called a capillary tubing string.

The fourth process is flow above critical velocity, where the well enters entrained mist flow in which the liquid and solids are entrained as mist, droplets or particles with the gas. Some of the liquid forms a layer on the perimeter surface of the production tubing and as velocity increases this layer thins and more liquid is fully entrained. Additionally, as velocity increases the amount of mist in the stream reduces for a given liquid production rate, further lightening the column.

For example, in the fourth state of mist flow, gas lift AL in CSM essentially requires a minimum velocity to entrain water droplets and solids with the gas in a well. The deeper the well the higher the pressure and the more gas required to entrain the water and solids (i.e., reach a critical carrying velocity). With deep high pressure wells, only high producing gas wells can naturally gas lift in mist flow, and continuous gas lift is required to achieve the critical flow operating state beyond slug flow. Further, in conventional CSM wells, with down bore pumps, gas is produced up the annulus of the well which is necessarily large and this reduces gas velocity. The alternative to raising gas velocity with increased flow is to decrease a well annulus size, but this may yield higher flowing pressure losses on a deep string well and is prone to blockage. Larger gas quantities, measured in standard cubic metres per hour (SCMH), are required to achieve a critical entrainment velocity in deeper wells largely due to increased pressure and thus density of the gas in the well, resulting in lower velocity with a given quantity of gas.

The operational principle of gas lift in a CSM well is as follows: If the well flow is below the critical velocity, additional gas is re-injected into the well tubing to maintain gas velocity up the well tubing sufficient to entrain and produce the water in the tubing. Generally, there is also a short start up step required to clear a well casing and tubing of logged up water, at the commencement of gas injection, which step is carefully controlled to limit slug flow prior to establishing gas flows above critical velocity that entrain water droplets. The use of a small, separate capillary tubing for unloading a logged up well further enhances the system by minimising the startup volume of gas required, and also does not place additional stress on the formation in the production tubing, as gas is introduced at a point where it acts to immediately lighten the column. Further, a small capillary tubing does not appreciably obstruct the production tubing—as for example a typical capillary tubing diameter can be less than ½". The alternatives of the prior art, including introducing gas from the surface, must raise well pressures sufficiently to eject/lift liquid until gas enters the production tubing to lighten the column. FIG. 1 is a schematic diagram of a gas lift artificial lift system 100, for applying gas lift artificial lift in a coal seam methane well, where the system 100 is shown in an idle state, according to some embodiments of the present disclosure. The system 100 includes a central tubing 105 in a wellbore 110 of a well, the tubing 105 having a well head end 115 terminating at a well head 117 and a sump end 120. An annulus 125 extends around the central tubing 105 between the well head end 115 and the sump end 120. Compressed gas storage vessels are included in a compressed natural gas (CNG) storage crate 130 and are connected to the annulus 125 via a gas lift gas line 135. A rotary vane gas compressor 140 is also connected to the gas lift gas line 135.

A flowline 145 connects the well head 117 to an input of the compressor 140. An automatically controlled flowline choke 150 is positioned in the flowline 145.

A two phase separator 155 is also positioned in the flowline 145 and separates the water and gas flowing in the flowline 145.

Those skilled in the art will appreciate that components of the system 100 are generally organised into a gas field gathering station 160 that serves multiple wellbores, including the wellbore 110. For example, additional flowlines 165 extending from other wellbores (not shown) can be connected in parallel to the flowline 145. Similarly, additional gas lift gas lines 170 can extend to the other wellbores and are connected in parallel to the gas lift gas line 135.

Also, a pressure control valve 175 can be positioned between the compressor 140 and the separator 155. Further, a gas booster 180 can be positioned in the gas lift gas line 135 between the compressor 140 and the well head end 115. Further, a casing head valve 185 can be positioned in the gas lift gas line near the well head end 115.

As illustrated in FIG. 1, in an idle state the wellbore 110, the tubing 105 and the annulus 125 are full of standing water. The water extends to the sump end 120 of the well, adjacent a coal seam 190. Therefore, to begin extracting coal seam methane from the coal seam 190, the water in the wellbore 110 must first be extracted.

Exemplary pressure values in units of barg are shown in FIG. 1 at various locations in the system 100. Readings of 0 barg at most points in the field gathering station 160 and at the well head end 115 of the wellbore 110 reflect the fact that, as illustrated in FIG. 1, the system 100 is in an idle state and has not yet begun operating to extract the water from the wellbore 110. A pressure of 15 barg is shown in the coal seam 190 and a pressure of 350 barg is maintained in the storage vessels of the CNG storage crate 130.

Figure 2:
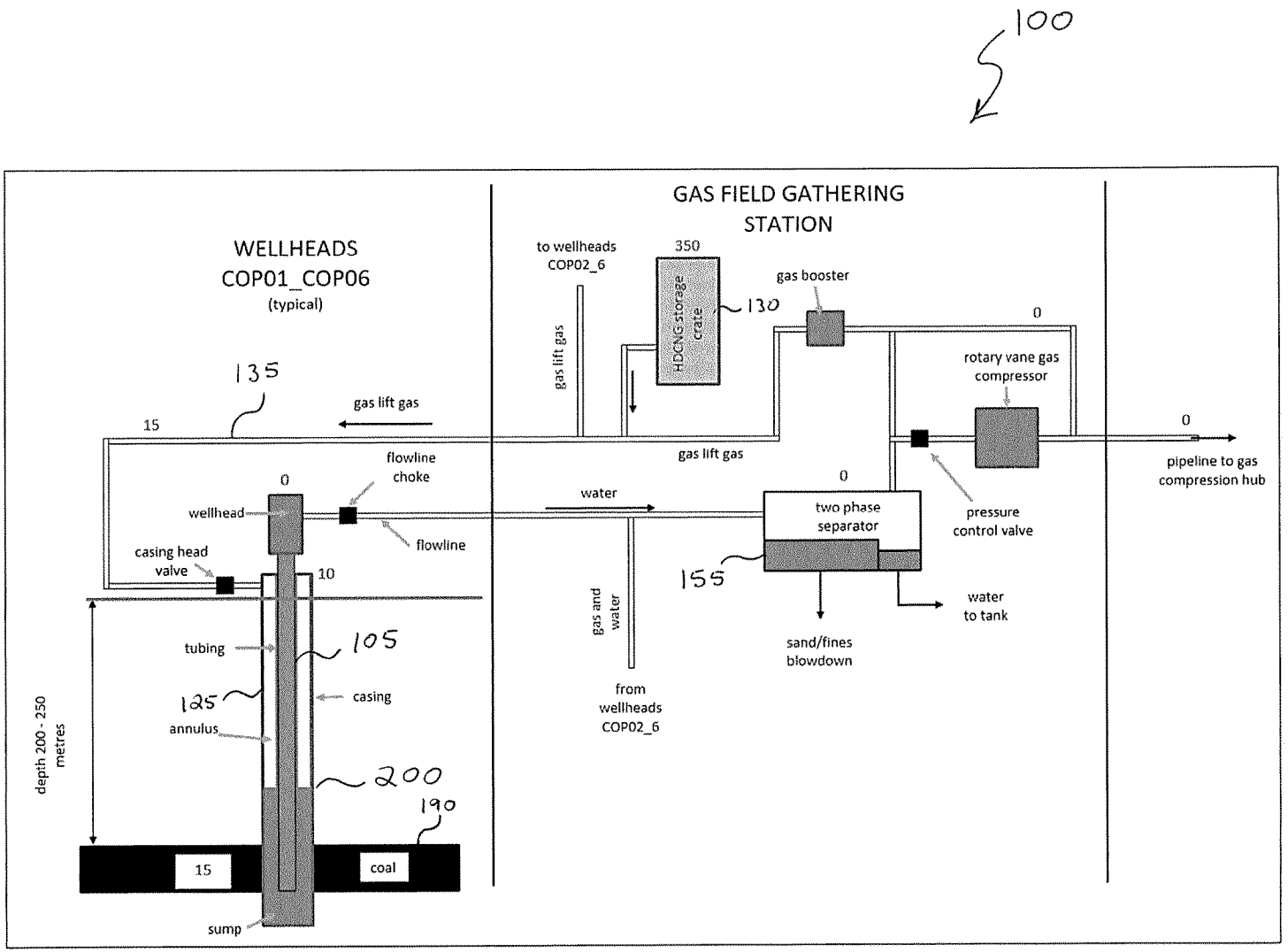
FIG. 2 is a further schematic diagram of the gas lift artificial lift system of FIG. 1, where the system is shown in an initial operating state, according to some embodiments of the present disclosure.

FIG. 2 is a further schematic diagram of the gas lift artificial lift system 100, for applying gas lift artificial lift in a coal seam methane well, where the system 100 is shown in an initial operating state, according to some embodiments of the present disclosure.

As shown by the illustrated pressure levels, in FIG. 2 a storage vessel in the CNG storage crate 130 has partially pressurised the gas lift gas line 135 to about 15 barg, and the casing head valve 185 has been partially opened. The gas from the gas lift gas line 135 has thus forced the water in the annulus 125 downward, which in turn directs the water upward through the tubing 105. A gas/water interface 200 progressively moves downward toward the sump end 120 of the wellbore 110 as additional gas is forced into the well head end 115 of the annulus 125.

Casing head pressure (CHP) at the top of the annulus 125 continues to rise, such as to 10 barg, as water in the annulus 125 is displaced with gas. However, only nominal back pressure is maintained at the two phase separator 155, as no gas or water is yet being produced from the coal seam 190.

Water forced out of the wellbore 110 flows through the flowline 145 to the two phase separator 155. Note that, for a typical well, the quantity of gas required to circulate the water out of the annulus 125 and tubing 105 may be on the order of 2000 litres, or 30 kg of gas, which generally represents only a very small proportion, of the gas stored in the storage crate 130, and by inspection provides for practical field implementation of storage.

Figure 3:
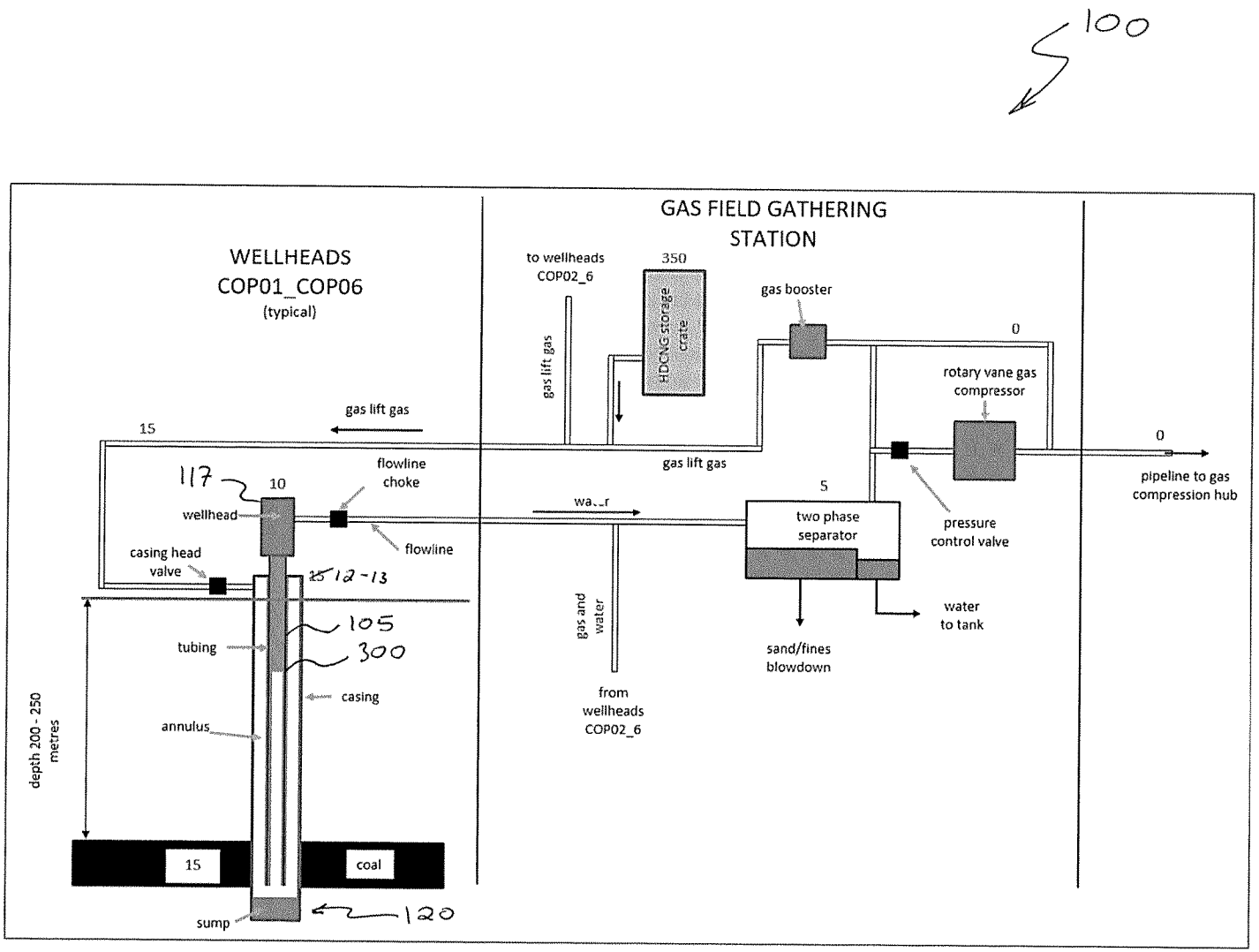
FIG. 3 is a further schematic diagram of the gas lift artificial lift system of FIG. 1, where the system is shown in a further initial operating state, according to some embodiments of the present disclosure.

FIG. 3 is a further schematic diagram of the gas lift artificial lift system 100, for applying gas lift artificial lift in a coal seam methane well, where the system 100 is shown in a further initial operating state, according to some embodiments of the present disclosure.

A gas/water interface 300 has now progressed from the sump end 120 of the wellbore 110 to closer to the top of the tubing 105. As the water in the tubing 105 is displaced to the separator 155, the backpressure on the well head 117 is increased by referencing the casing head pressure. When the annulus 125 is entirely filled with gas, the casing head pressure is a valid proxy for bottom hole pressure at the sump end 120 of the annulus 125.

Next, the automated flowline choke 150 employs a proportional-integral-derivative (PID) control loop to maintain a constant bottom hole pressure, which ensures that no gas or water is yet being produced from the coal seam 190. Further, the separator 155 is shown pre-charged, for example to 5 barg.

Figure 4:
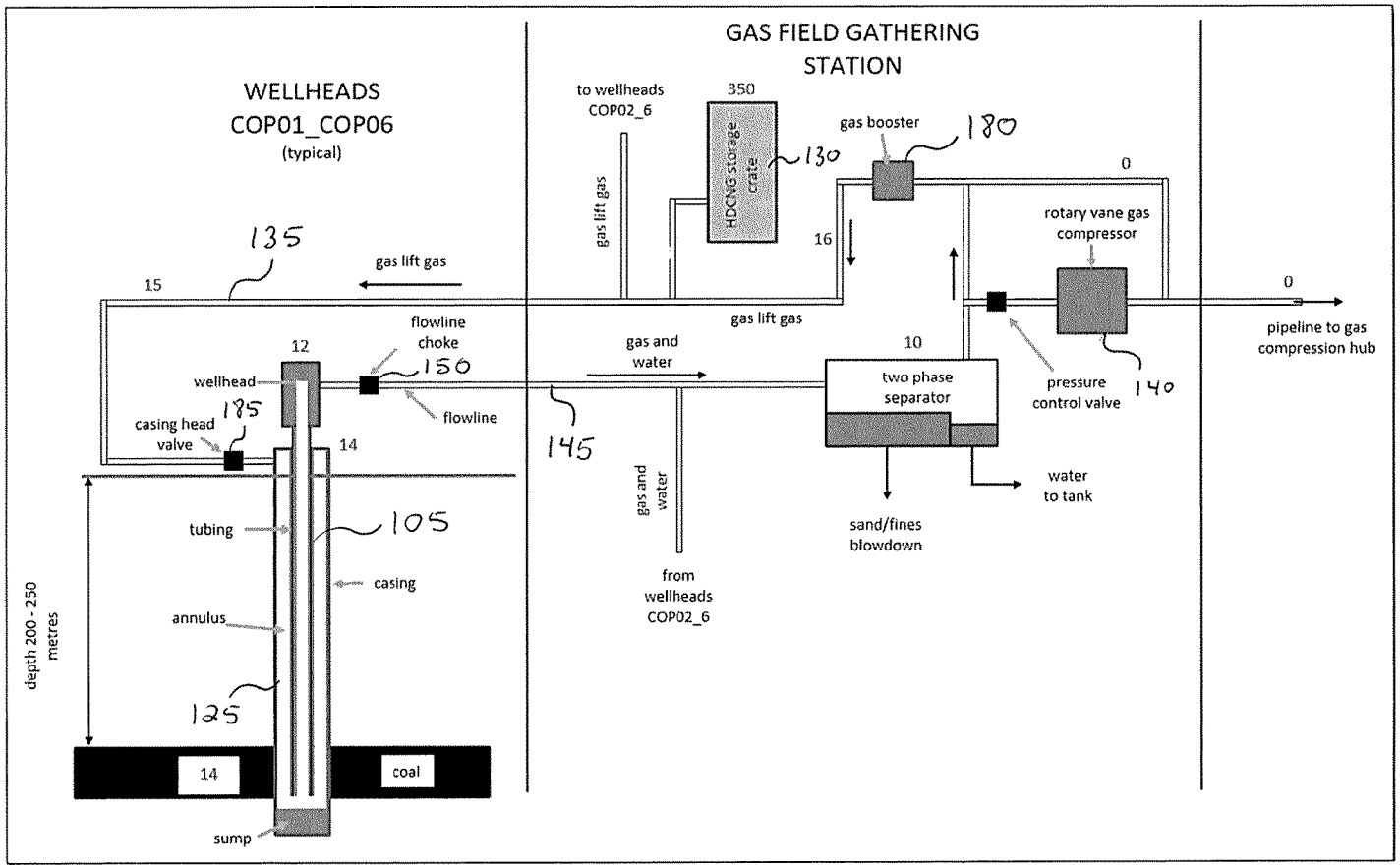
FIG. 4 is a further schematic diagram of the gas lift artificial lift system of FIG. 1, where the system is shown after the dewatering of the wellbore is complete and just before a steady state operating state, according to some embodiments of the present disclosure.

FIG. 4 is a further schematic diagram of the gas lift artificial lift system 100, for applying gas lift artificial lift in a coal seam methane well, where the system 100 is shown after the dewatering of the wellbore 110 is complete and just before a steady state operating state, according to some embodiments of the present disclosure.

Gas from the CNG storage crate 130 is no longer used, and rather gas is circulated through the flowline 145 and the gas lift gas line 135 using the gas booster 180. The back pressure on the well head 117 is set to maintain a desired bottom hole pressure, such as about 14 barg, which allows water and gas to flow from the coal seam 190 into the annulus 125 and tubing 105 at the sump end 120 of the wellbore 110.

The flowline choke 150 maintains a constant casing head pressure, which is essentially equal to the flowing bottom hole pressure. Pressure in the two phase separator 155 has risen to 10 barg, and a gas flare (not shown) is used to remove excess gas from the system 100.

The flowline choke 150 and the casing head valve 185 work in tandem to achieve the above described steady state operation. The flowline choke 150 modulates flow through the flowline 145 to control the pressure in the well casing (i.e., the pressure in the tubing 105 and annulus 125, which pressure is generally uniform from the well head end 115 to the sump end 120 during steady state operation of the system 100). The bottom hole pressure at the sump end 120 determines the desorption/production rate of the gas from the coal seam 190. This is based on a position on desorption isotherms—such that if the pressure is balanced on the saturation point of an isotherm, production from the coal seam 190 is zero.

If the bottom hole pressure is set to create low or no production conditions, the gas flow in the tubing 105 will drop below critical flow rates for gas lift of water. In such circumstances additional gas is introduced to the gas lift gas line 135. The additional gas may initially be supplied from the CNG storage crate 130, but in a continuous application gas is circulated through the flowline 145 and the gas lift gas line 135 using the gas booster 180, and no gas is required from the storage crate 130. The additional gas is circulated via the casing head valve 185 such as to maintain a minimum critical velocity.

The minimum critical velocity for entrainment is calculated using industry known formulas, which are a function of the liquid surface tension, the density of the liquid and the density of the gas. The liquid surface tension and density of water essentially remain constant and thus an appropriate calculation can be made using bottom hole pressure and temperature to determine the remaining variable gas density. The temperature essentially remains constant and thus bottom hole pressure can be used along with the internal diameter of the tubing 105 to calculate a required flow rate to achieve critical velocity in the tubing 105. The flowline choke 150 automatically closes in response to extra gas flow, in order to maintain both the pressure in the well casing and the desired production rate. An empirical water production rate factor can be used to adjust the critical velocity.

For example, at a depth of 200 m, a 1¼" internal diameter in the tubing 105 requires approximately 200 SMCH to effectively entrain water with a bottom hole pressure of 1500 kPa, and thus create a critical water entrainment carrying velocity. This low critical flow rate/velocity means that once flowing, for the majority of the life of the wellbore 110, no gas lift circulation (and thus no electric power for compression) is required. Further, as the bottom hole pressure at the sump end 120 decreases, with CSM production life, entrainment velocities are achieved at lower SCMH flow rates. This effect can be useful, because for most of the life of a well if an appropriate diameter tubing 105 is selected, then critical flow rates are achieved using production gas only and no gas recirculation energy is required, i.e., no pumping energy is required and the coal formation provides the energy to lift the water. The system 100 can thus be seen to be more energy efficient than traditional down hole pumps that consume power and operate for the life of the well.

Also, according to some embodiments, in the case of retrofit of a gas lift artificial lift system 100 to an existing well the conventional pump is removed and production tubing 105 sized to ensure gas lift under the expected flow conditions may be installed inside the existing tubing.

According to some embodiments, a foot valve/check valve 400 is provided on the sump end 120 of the tubing 105. The valve 400 can be used to ensure that the tubing 105 can be kept clear of water/silt when the wellbore 110 is shut in by maintaining a pressure in the tubing 105 that is higher than a pressure in the annulus 125.

Figure 5:
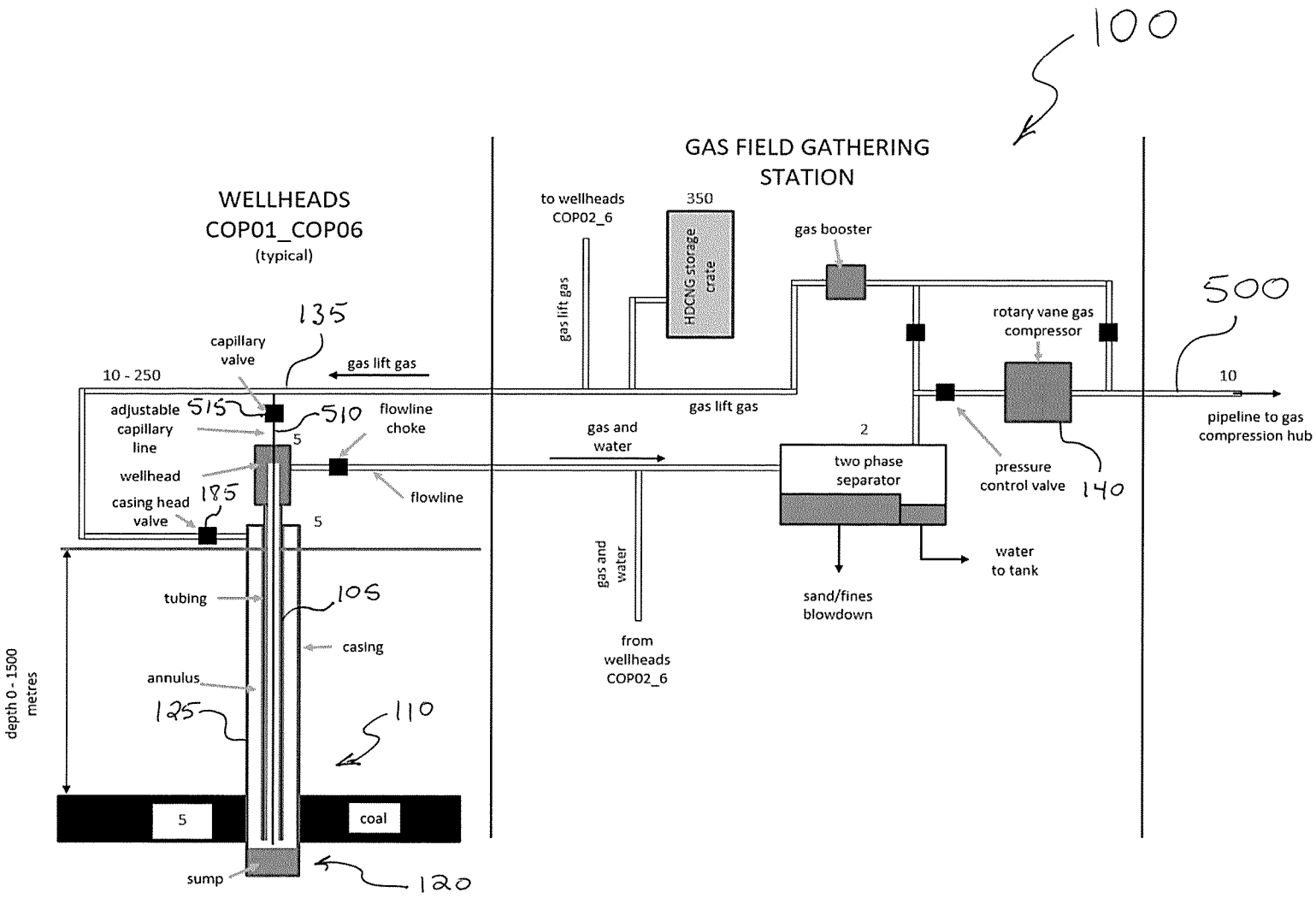
FIG. 5 is a further schematic diagram of the gas lift artificial lift system of FIG. 1, where the system is shown during steady state operation, according to some embodiments of the present disclosure.

FIG. 5 is a further schematic diagram of the gas lift artificial lift system 100, for applying gas lift artificial lift in a coal seam methane well, where the system 100 is shown during steady state operation, according to some embodiments of the present disclosure.

During steady state operation, the velocity of the gas flowing up the tubing 105 is above a critical velocity that enables the gas flow to effectively entrain water. The compressor 140 compresses the gas that exits the separator 155 to about 8 barg before the gas is injected into a gas compression hub (not shown) from an output 500 of the gas field gathering station 160.

During steady state operation, the level of gas lift artificial lift provided to the wellbore 110 can be varied by adjusting the casing head valve 185 and the speed of the compressor 140 so as to maintain a critical velocity of the flow in the tubing 105. The internal diameter of the tubing 105 can be sized for the well production rate, ensuring that minimal or no additional gas recirculation is required unless the well production is deliberately turned down. The ability to turn down the gas production from a CSM well, by varying bottom hole pressure, whilst maintaining gas lift of the water with increased recirculation, provides effective well gas production control. The well will not log with water and the gas can be produced according to demand and preserved in the field for later production.

Alternatively, gas lift artificial lift can be used to increase bottom hole pressure at the sump end 120 of the wellbore 110 to a point above a shut-in bottom hole pressure before shutting in the wellbore 110 to restrict water ingress.

In the event that a work over is required on the wellbore 110, a Rig or Coil Tubing Unit (CTU) (not shown) can be used to re-enter the wellbore 110 and undertake down hole work, including repair and maintenance. In some embodiments, and as shown in FIG. 5, an adjustable capillary line 510, as can be used in a work over, can be left permanently in the well, where the line 510 extends down the tubing 105 or annulus 125 to the sump. The adjustable capillary line 510 is periodically pulsed with liquid and/or gas, such as through a capillary valve 515 connected to the gas lift gas line 135 and to the capillary line 510, to elutriate the sump. Such elutriation of the gas lift artificial lift system 100 can be effective to periodically clear solids from the sump with the entrained gas lift flow.

Further, because solids are generally more readily entrained and lifted with water, in a dry well clean water can be recirculated down the annulus 125 of the system 100 to provide water for lifting solids during the gas lift artificial lift process. Water also can be delivered via the capillary line 510, either as pure water or in combination with gas. The addition of water to produce solids can also reduce the erosive nature of the solids producing up the well.

Figure 6:
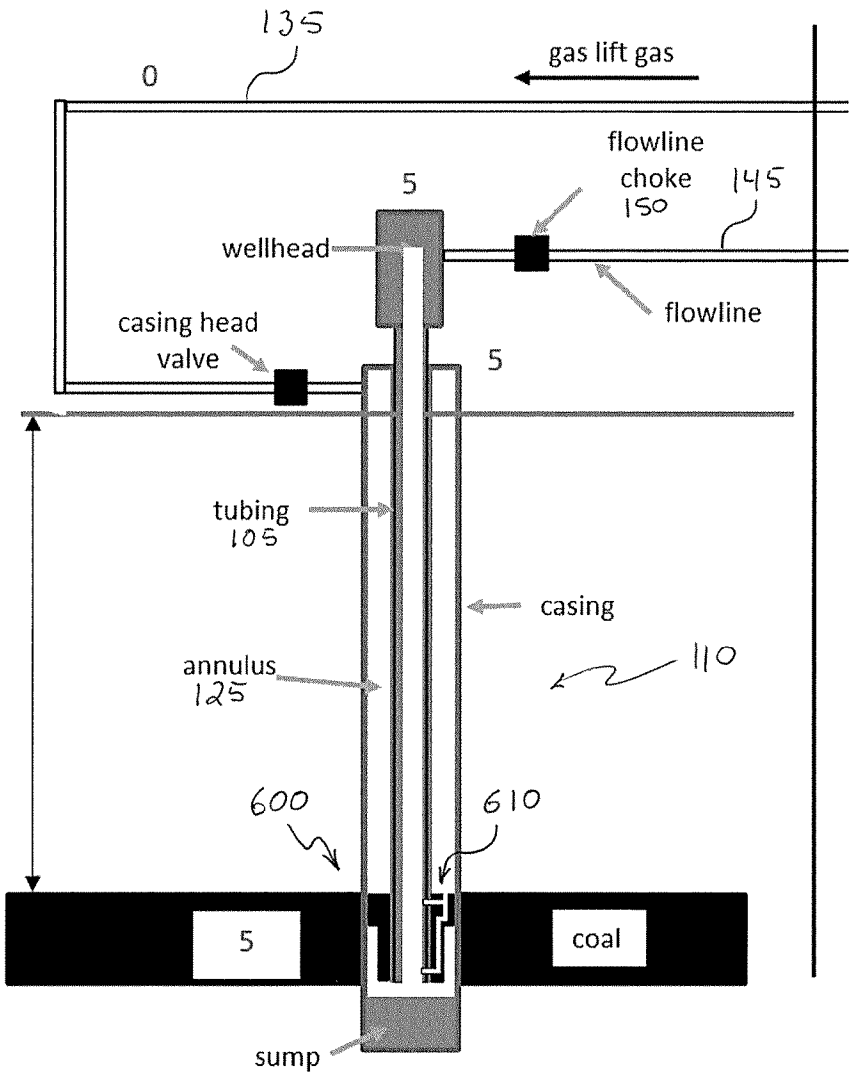
FIG. 6 is a close up view of the wellbore of the system of FIG. 1, where the sump end of the wellbore has been fitted with a packer, according to some embodiments of the present disclosure.

FIG. 6 is a close up view of the wellbore 110, where the sump end 120 has been fitted with a packer 600, according to some embodiments of the present disclosure.

The packer 600 seals the annulus 125 from the wellbore (i.e., the sides of the wellbore 110) with one or more gas injection ports 610, allowing gas to be injected at various points in the tubing 105. As shown, upper and lower gas injection ports 610 may each consist of multiple ports and may be sized differently to provide enhanced gas production and de-watering performance.

Figure 7:
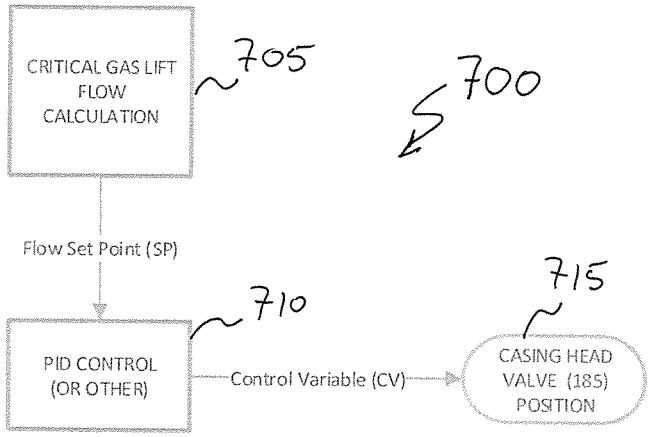
FIG. 7 is a schematic flow diagram of a control subsystem used to control a position of a casing head valve of the gas lift artificial lift system of FIG. 1, according to some embodiments of the present disclosure.

FIG. 7 is a schematic flow diagram of a control subsystem 700 used to control a position of the casing head valve 185 of the gas lift artificial lift system 100, according to some embodiments of the present disclosure. At block 705 a critical gas lift flow calculation of a flow set point is performed using the following as input data: The production pressure measured on the annulus 125; the diameter of the tubing 105; and an empirical water production factor. The flow set point is then input into a PID control algorithm 710, which uses a measured flow rate of the flowline 145 to output a valve control variable. At block 715 the control variable is then converted to a position of the casing head valve 185.

Figure 8:
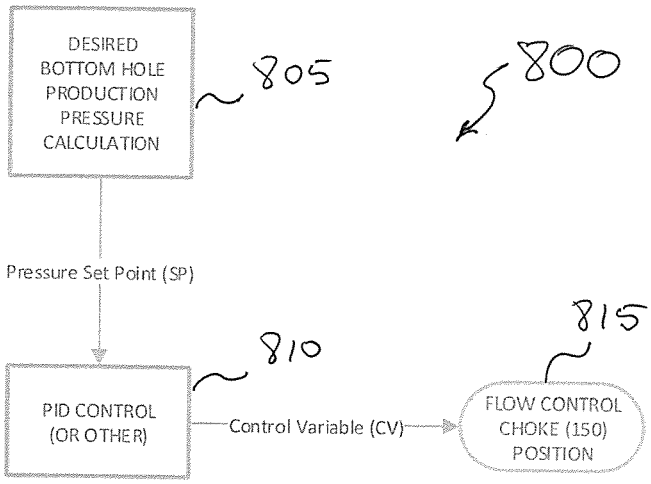
FIG. 8 is a schematic flow diagram of a control subsystem used to control a position of a flowline choke of the gas lift artificial lift system of FIG. 1, according to some embodiments of the present disclosure.

FIG. 8 is a schematic flow diagram of a control subsystem 800 used to control a position of the flowline choke 150 of the gas lift artificial lift system 100, according to some embodiments of the present disclosure. At block 805 a desired bottom hole production pressure set point is calculated using the following as input data: A requested gas production flow rate; a current saturated position on a relevant isotherm; a production isotherm; and a maximum allowed formation differential pressure from saturation on the production isotherm. The pressure set point is then input into a PID control algorithm at block 810, which uses a measured production pressure in the annulus 125 to output a choke control variable. At block 815 the choke control variable is then converted to a position of the flowline choke 150.

Figure 9:
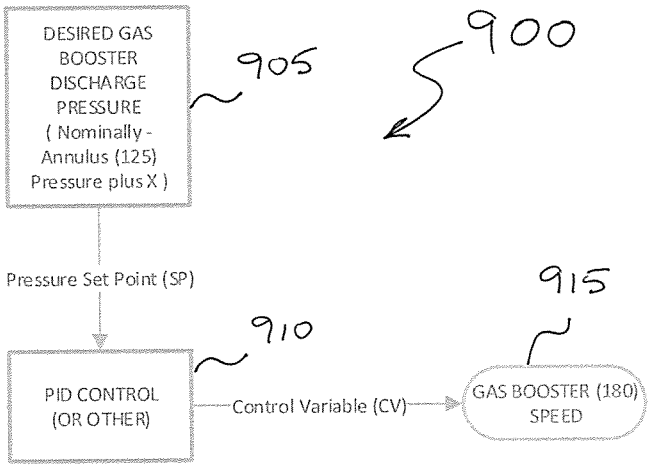
FIG. 9 is a schematic flow diagram of a control subsystem used to control a speed of a gas booster of the gas lift artificial lift system of FIG. 1, according to some embodiments of the present disclosure.

FIG. 9 is a schematic flow diagram of a control subsystem 900 used to control a speed of the gas booster 180 of the gas lift artificial lift system 100, according to some embodiments of the present disclosure. At block 905 a desired gas booster discharge pressure, which is generally a desired pressure in the annulus 125 plus a correction value, is used to define a pressure set point. The pressure set point is then input into a PID control algorithm at block 910, which uses a measured pressure of the gas lift gas line 135 to output a speed control variable. At block 915 the speed control variable is then converted to a speed of the gas booster 180.

Figure 10:
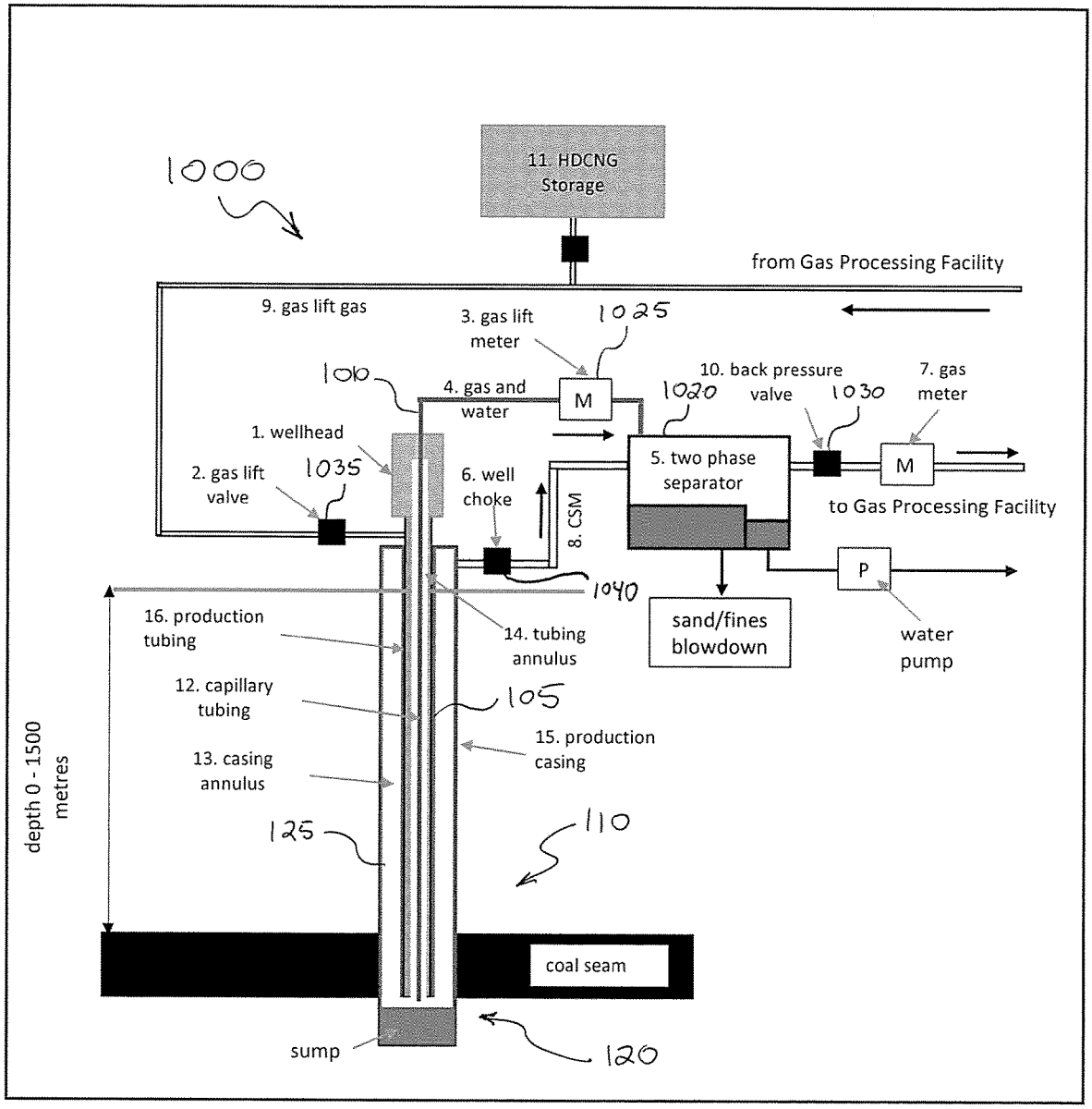
FIG. 10 is a schematic diagram of a gas lift artificial lift system, where a capillary tubing is used to lift water and gas from a wellbore, according to an alternative embodiment of the present disclosure.

FIG. 10 is a schematic diagram of a gas lift artificial lift system 1000, where an additional tubing in the form of a capillary tubing 1010 is installed inside the tubing 105 and is used to lift water and gas from a wellbore 110, according to an alternative embodiment of the present disclosure. Unlike in the system 100 shown in FIG. 5, in the system 1000 the capillary tubing 1010 is directly connected to a two phase separator 1020. That enables the capillary tubing 1010 to also draw gas and water from a sump end 120 of the wellbore 110.

For purposes of the present specification, the capillary tubing 1010 is defined as a tubing that is relatively smaller than the tubing 105, and which defines an annular space between an outer diameter of the capillary tubing 1010 and an inner diameter of the tubing 105. For example, in a typical application the capillary tubing 1010 may have an inner diameter between 10 mm to 30 mm, and the tubing 105 may have an inner diameter between 50 mm to 70 mm, however those skilled in the art will appreciate that various other relative dimensions also can be used.

Control of a gas flow rate in the capillary tubing 1010, as measured by a two phase flow meter 1025, is maintained by adjusting a separator back pressure valve 1030. In circumstances where the production rate of the wellbore 110 is adequate to achieve critical flow in the capillary tubing 1010, the capillary tubing 1010 will entrain water and particulates and transport them out of the wellbore 110 and to the separator 1020.

Further, in circumstances where the production rate of the wellbore 110 is inadequate to achieve critical flow in the capillary tubing 1010, additional gas can be injected into the tubing 105 (i.e., in the annulus around the capillary tubing 1010), using a surface mounted gas lift valve 1035, to achieve a critical velocity in the capillary tubing 1010 that entrains water and particulates and transports them to the separator 1020.

By way of example, referring again to FIG. 10, in normal operation a bottom hole pressure and thus gas production rate is set and controlled using a well choke valve 1040. A desired flow rate to maintain critical gas lift flow in the capillary tubing 1010 is simultaneously maintained by varying the pressure in the separator 1020 using the back pressure valve 1030, and the gas lift valve 1035 is closed as additional gas lift gas is not required. Should a desired well production flow rate be lower than that required to maintain gas lift in the capillary tubing 1010, the well choke valve 1040 is closed or placed at a minimum position. Additional gas is then circulated via the gas lift valve 1035 to maintain a desired critical gas lift flow rate in the capillary tubing 1010, and a bottom hole pressure at the sump end 120 is controlled by varying the pressure in the separator 1020 using the back pressure valve 1030. The gas lift flow rate can be measured using the two phase flow meter 1025 or estimated via an alternate method such as a differential calculation between the bottom hole pressure and the pressure in the separator 1020.

Figure 11:
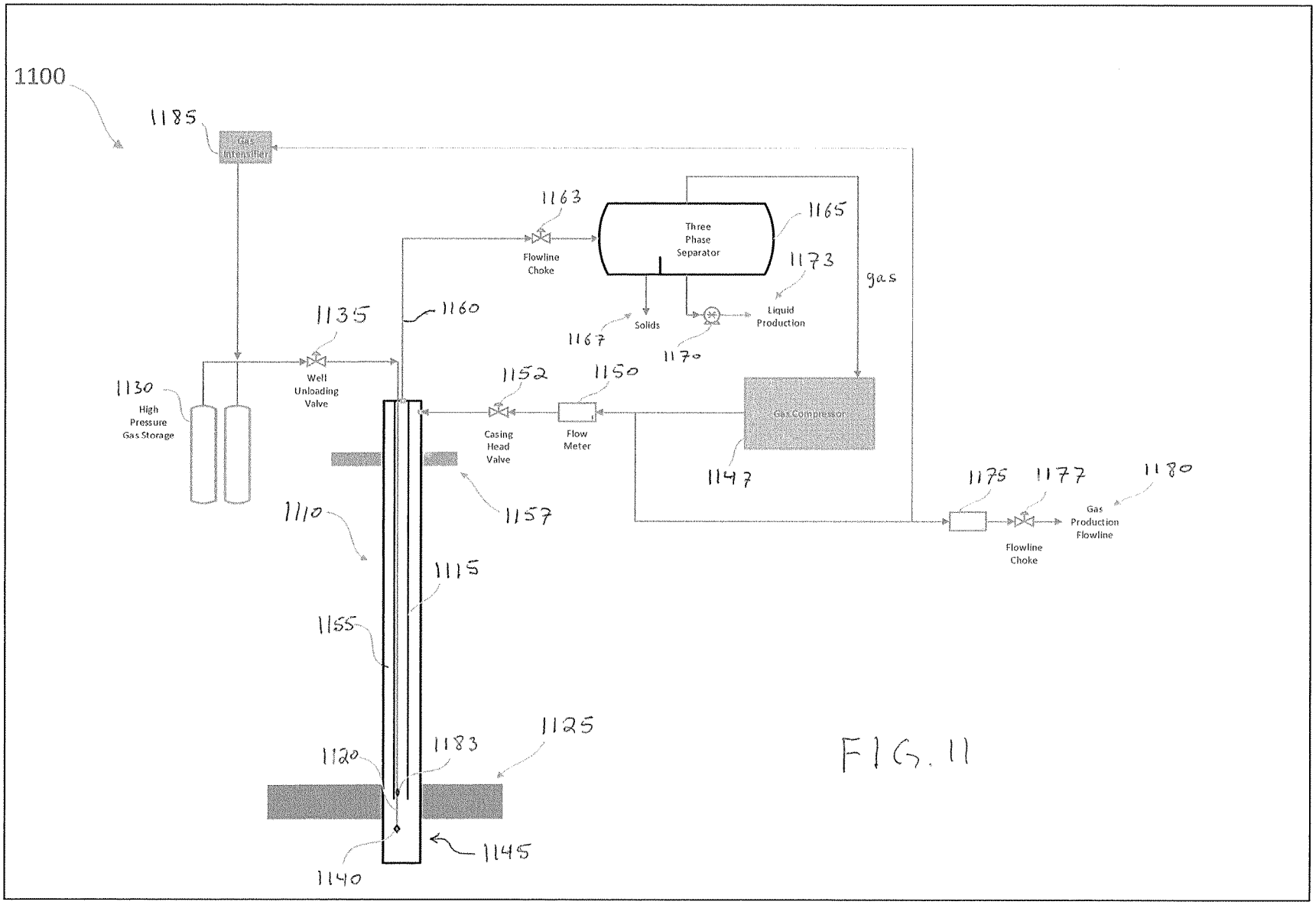
FIGS. 11, 12 and 13 are schematic diagrams illustrating gas lift artificial lift systems for use in general application across applications including oil wells, natural gas wells, shale gas wells, and coals seam methane well applications, according to alternative embodiments of the present disclosure.
Figure 12:
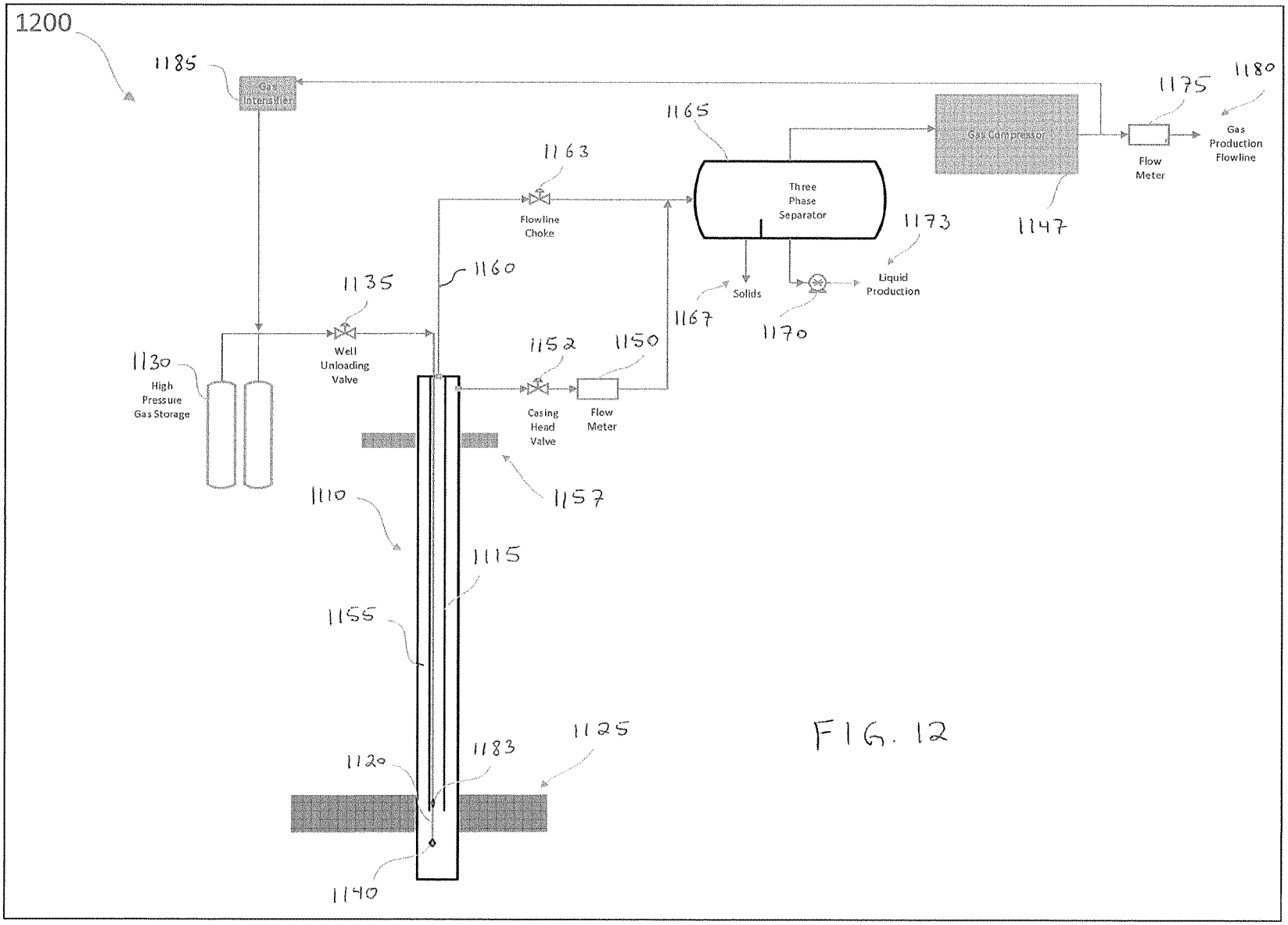
Figure 13:
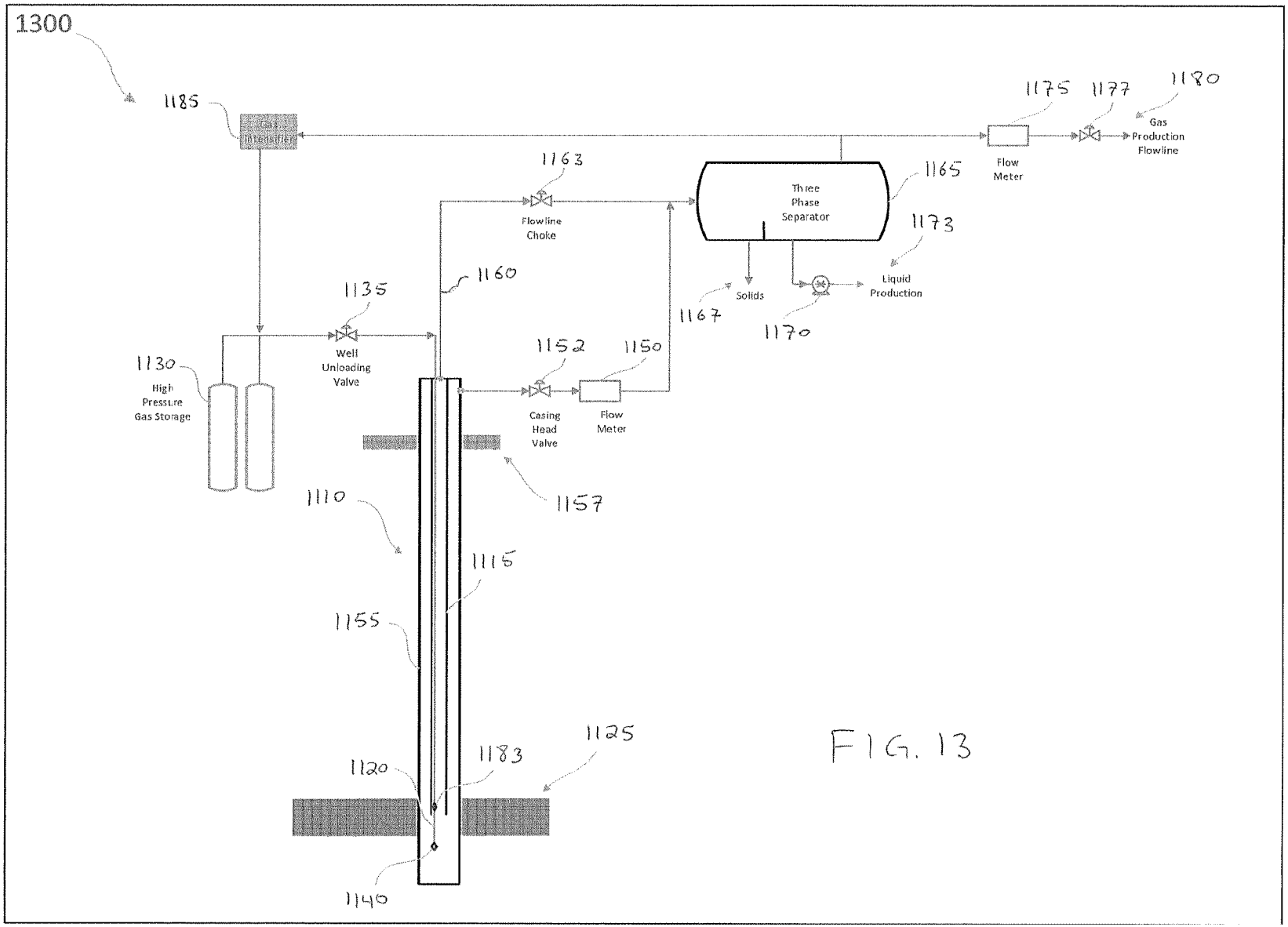

FIGS. 11, 12 and 13 are schematic diagrams illustrating gas lift artificial lift systems for use in general application across applications including oil wells, natural gas wells, shale gas wells, and coals seam methane well applications, according to alternative embodiments of the present disclosure. FIG. 11 illustrates a system 1100 including a wellbore 1110, a central tubing 1115, and a capillary tubing 1120 extending to an oil deposit 1125. For example, the capillary tubing 1120 can be ½" stainless steel tubing.

During an unloading process, for example when there is significant sand or other solids in the wellbore 1110, high pressure gas, which is gas at a pressure above the high bottom hole pressure of the logged up well plus some additional pressure to take into account the flowing loss of the capillary tubing 1120, is released from a gas storage 1130 (e.g., similar to the CNG storage crate 130 discussed above) through a well unloading valve 1135 into the capillary tubing 1120. The pressure in the capillary tubing 1120 opens a pressure-activated elutriation valve 1140 near a sump end 1145 of the wellbore 1110. The high pressure gas elutriates the sand/solids and allows them to be lifted out of the wellbore 1110, thus achieving an unloading of the wellbore 1110. The use of the separate high pressure capillary tubing 1120 for unloading enables a gas lift AL compressor to be designed to achieve very low well head pressures, potentially below atmospheric pressures, thus providing an ability to achieve low bottom hole pressures while maximising production and offsetting the problems generally associated with the additional head required when gas lifting liquids. Further, the low gas flow rate required to unload the well using the capillary tubing 1120 results in only a minimal pressure drop down the capillary tubing 1120 during unloading.

The flowrate (e.g., kg/hour) to achieve gas lift from the wellbore 1110 can be set to minimise Flowing Bottom Hole Pressure (FBHP).

During steady state operation of the system 1100, a gas compressor 1147 directs lower pressure gas, which only needs to be at a pressure above the lowered bottom hole pressure of the unloaded well plus some additional pressure to account for the low flowing loss of the annulus 1155, through a flow meter 1150 and casing head valve 1152 into an annulus 1155 at a well head end 1157 of the wellbore 1110. Using the annulus 1155 as opposed to the capillary tubing 1120 in steady state operation thus minimises the compression requirement.

Produced flow (including solids, liquid and gas) from the wellbore 1110 flows through a flowline 1160 to a secondary flowline choke 1163, and then to a three phase separator 1165. The secondary flowline choke 1163 enables trimming of the gas pressure from the well and also aids start-up during high pressure well unloading by controlling slug flow. Solids that are separated in the three phase separator 1165 are directed to a solids processing unit 1167. Liquids that are separated in the three phase separator 1165 are directed to a pump 1170 and then to a liquid production pipeline 1173. Gas that is separated in the three phase separator 1165 is directed back to the gas compressor 1147.

Excess gas from the compressor 1147, which is gas that does not flow through the casing head valve 1152, flows to a flow meter 1175 and to a primary flowline choke 1177 before entering a gas production flowline 1180. The primary flowline choke 1177 controls pressure in the three phase separator 1165.

Also, during steady state operation of the system 1100, or where the well is logged up with only water, the well unloading valve 1135 can be opened slightly to allow medium pressure gas, which is gas at a pressure above the lowered bottom hole pressure plus some additional pressure due to the head of standing liquid and the flowing losses of the capillary tubing 1120, to bleed into the central tubing 1115 through an unloading port 1183 in the capillary tubing 1120. The gas flow rate can be set to minimise the flowing losses in the capillary tubing 1120, allowing the capillary injection pressure to be used to measure the liquid level by differential when compared with the casing head pressure that also takes into account low flowing losses.

Some of the excess gas from the compressor 1147 also can be diverted to a gas intensifier 1185, where it is used to recharge the gas storage 1130.

FIG. 12 illustrates a system 1200 that is a variant of the system 1100 described above. In this embodiment, rather than recycling gas from the gas compressor 1147 through the casing head valve 1152 to the well annulus 1155, all gas from the compressor 1147 flows either to the gas production flowline 1180 or to the gas intensifier 1185.

FIG. 13 illustrates a system 1300 that is another variant of the systems 1100 and 1200 described above. In the system 1300, when the gas pressure in the flowline 1160 is adequate, and due to significant gas production in the wellbore 1110, the gas compressor 1147 can be removed from the system 1200 or moved to a downstream facility. Thus in the system 1300 gas that is separated in the three phase separator 1165 flows directly to either the gas intensifier 1185 or to the production flowline 1180.

Figure 14:
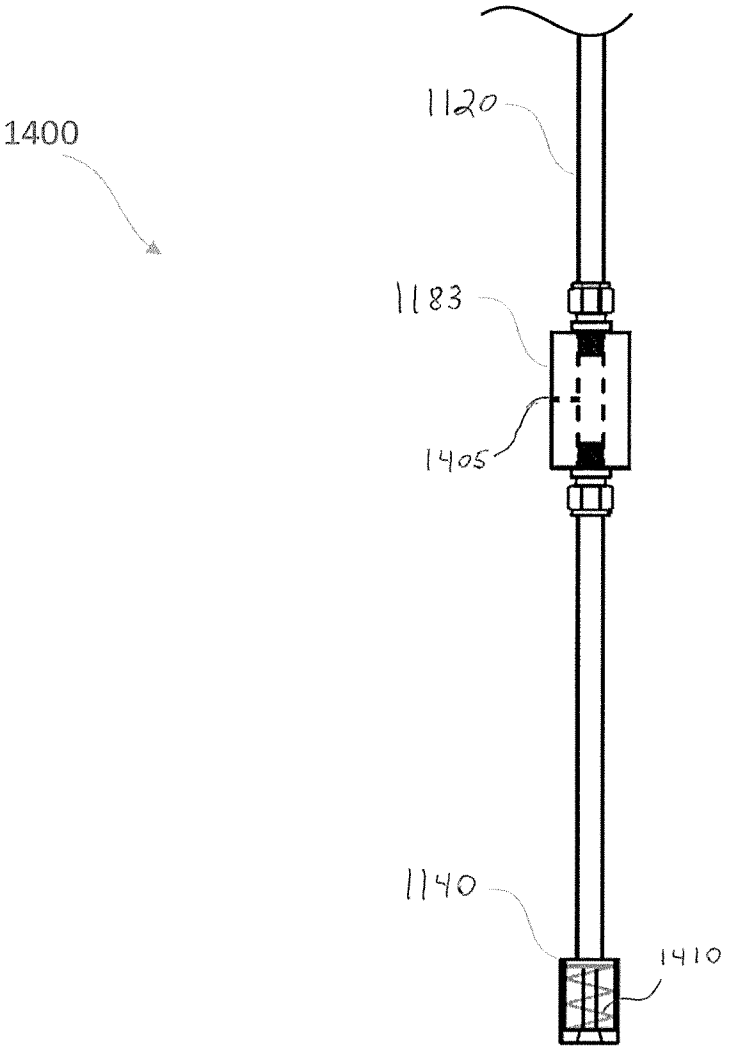
FIG. 14 illustrates a close-up side view of the sump end of the capillary tubing employed in the systems of FIGS. 11, 12 and 13.

FIG. 14 illustrates a close-up side view of the sump end of the capillary tubing 1120. The unloading port 1183 includes a bleed hole 1405 that vents to the central tubing 1115. The pressure-activated elutriation valve 1140 can be activated, for example, using a coil spring 1410 that is biased to a closed position and where the valve 1140 opens at a pre-set pressure. The method of unloading with a higher pressure and higher flow in the capillary tubing 1120 provides sump elutriation, enabling solids to be produced. That eliminates the need for conventional well workovers to unload solids from the well sump, which solids can otherwise reach levels that may obstruct the production tubing.

The above description of various embodiments of the present disclosure is provided for purposes of description to one of ordinary skill in the related art. It is not intended to be exhaustive or to limit the disclosure to a single disclosed embodiment. Numerous alternatives and variations to the present disclosure will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present disclosure that have been discussed herein, and other embodiments that fall within the spirit and scope of the above described disclosure.

The invention claimed is:

1. A system for applying gas lift artificial lift, the system comprising:

a central tubing in a well hole of a well, the central tubing having a well head end and a well sump end, and fluid in the central tubing defines a fluid column;

an annulus that extends around the central tubing between from the well head end to the sump end;

a compressed gas source;

a gas lift gas line connecting the compressed gas source to the well hole;

a gas compressor having an input and an output, wherein the output is connected to the annulus;

a flowline connected to the well head end of the central tubing such that fluid flowing upward through the central tubing and forced out of the well bore flows through the flowline;

an automatically controlled flowline choke in the flowline; and an additional tubing inserted down the central tubing to provide gas for initial unloading of the well;

wherein the fluid flowing upward through the central tubing surrounds the additional tubing, and gas introduced to the central tubing from the additional tubing acts to immediately lighten the fluid column in the central tubing.

2. The system of claim 1, wherein the compressed gas source is a compressed gas storage vessel.

3. The system of claim 1, further comprising a two or three phase separator positioned in the flowline and connected to the input of the gas compressor.

4. The system of claim 3, further comprising a separator back pressure valve in the flowline to control the pressure of the separator, the separator back pressure valve disposed between the two or three phase separator and the input of the gas compressor.

5. The system of claim 1, further comprising a gas booster positioned in the gas lift gas line between the compressed gas source and the gas compressor.

6. The system of claim 1, further comprising a plurality of wellbores connected in parallel to both the flowline and the gas lift gas line.

7. The system of claim 1, wherein the automatically controlled flowline choke comprises a control valve.

8. The system of claim 1, wherein the automatically controlled flowline choke comprises a control valve and flow meter.

9. The system of claim 1, further comprising a casing head valve positioned in the gas lift gas line between the compressed gas storage vessel and the annulus.

10. The system of claim 9, wherein the flowline choke and the casing head valve are automatically modulated in tandem by a controller, whereby the controller adjusts a flow rate in the central tubing to maintain a critical velocity of gas through the central tubing and a desired production pressure, the flow rate to maintain the critical velocity calculated based on an internal diameter of central tubing.

11. The system of claim 1, further comprising a packer positioned adjacent the central tubing in the wellbore and wherein select sized gas passages extend through the packer.

12. The system of claim 1, wherein the central tubing extends below an intersection of a vertical well and a horizontal well and into a sump.

13. The system of claim 1, wherein the additional tubing is inserted down the central tubing and extends beyond the central tubing at the sump end into a sump whereby solids in the sump are elutriated.

14. The system of claim 1, wherein the additional tubing is a capillary tubing.

15. The system of claim 1, wherein the additional tubing is installed in the central tubing to provide a separate gas lift tube.

16. The system of claim 1, wherein the automatically controlled flowline choke is a primary flowline choke or a secondary flowline choke.

17. The system of claim 1, wherein the additional tubing comprises an unloading port and a pressure-activated elutriation valve at a distal end of the additional tubing.

18. A system for applying gas lift artificial lift in a well having a well head end and a well sump end, the system comprising:

a central tubing in a well hole of the well, the central tubing extending from the well head end to the well sump end, and fluid in the central tubing defines a fluid column;

an annulus that extends around the central tubing from the well head end to the sump end;

a gas compressor having an input and an output, wherein the output is connected to the annulus;

a flowline connected to the well head end of the central tubing;

an automatically controlled flowline choke in the flowline;

a compressed gas source; and a capillary tubing string in the well hole, connected to the compressed gas source and extending from the well head end to beyond the central tubing at the sump end;

wherein gas introduced to the central tubing from the capillary tubing acts to immediately lighten the fluid column in the central tubing.

19. The system of claim 18, further comprising:

a gas flow measurement device located between the compressed gas source and the well head end to measure gas flow into the annulus;

an automatically controlled gas lift flow control valve in a gas lift gas line located between the gas compressor and the well head end;

a pressure measurement device located on or adjacent to the well head end to measure pressure in the capillary tubing string; and a control system that regulates: the automatically controlled flowline choke, the automatically controlled gas lift flow control valve, and an output of the gas compressor based on inputs from the gas flow measurement device and the pressure measurement device.

20. The system of claim 18, wherein the flowline is connected to the well head end of the central tubing such that fluid flowing upward through the central tubing flows through the flowline, and wherein the capillary tubing string is inserted down the central tubing such that the fluid flowing upward through the central tubing surrounds the capillary tubing string.

* * * * *